United States Patent [19]

Zmich et al.

[11] Patent Number: 4,795,846

[45] Date of Patent: Jan. 3, 1989

[54] PROCESS FOR THE DEHYDROCYCLIZATION OF ALIPHATIC HYDROCARBONS

[75] Inventors: Joseph Zmich, Westmont; Michael B. Russ, Elmhurst; Visnja A. Gembicki, Clarendon Hills, all of Ill.

[73] Assignee: UOP Inc., Des Plaines, Ill.

[21] Appl. No.: 103,554

[22] Filed: Oct. 1, 1987

[51] Int. Cl.[4] ..... C10G 35/06; C07C 2/52

[52] U.S. Cl. ..... 585/417; 585/419; 585/444; 585/445; 208/137

[58] Field of Search ..... 585/417, 419, 443, 444, 585/445; 208/137

[56] References Cited

U.S. PATENT DOCUMENTS

| | | | |
|---|---|---|---|
| 4,104,320 | 8/1978 | Bernard et al. | 260/673.5 |
| 4,434,311 | 2/1984 | Buss et al. | 585/444 |
| 4,435,283 | 3/1984 | Buss et al. | 585/419 |
| 4,456,527 | 6/1984 | Buss et al. | 208/89 |
| 4,627,912 | 12/1986 | Field | 708/139 |
| 4,645,588 | 2/1987 | Buss et al. | 585/419 |
| 4,650,565 | 3/1987 | Jacobson et al. | 585/419 |
| 4,652,689 | 3/1987 | Lambert et al. | 585/415 |

*Primary Examiner*—Asok Pal

*Attorney, Agent, or Firm*—Thomas K. McBride; John F. Spears, Jr.; David M. Frischkorn

[57] ABSTRACT

An improved dehydrocyclization process for the selective conversion of light hydrocarbons to aromatics is presented. The activity of a catalyst containing non-acidic L-zeolite is greatly enhanced by the addition of water, water precursors, or mixtures thereof to the reaction zone during the dehydrocyclization reaction. Addition of between 10 and 100 wt. ppm $H_2O$ results in a higher product yield of aromatics with increased product octane.

8 Claims, No Drawings

PROCESS FOR THE DEHYDROCYCLIZATION OF ALIPHATIC HYDROCARBONS

BACKGROUND OF THE INVENTION

The present invention is directed toward an improved dehydrocyclization process where light paraffinic hydrocarbons are converted with high selectivity to aromatics. More particularly, the activity of a nonacidic L-zeolite containing dehydrocyclization catalyst is enhanced by including water, water precursors, or mixtures thereof in a reaction zone with a $C_6$–$C_{10}$ hydrocarbon feedstock.

In the past, it has become the practice to effect conversion of aliphatic hydrocarbons to aromatics by means of the well-known catalytic reforming process. In catalytic reforming, a hydrocarbonaceous feedstock, typically a petroleum naphtha fraction, is contacted with a Group VIII-containing catalytic composite to produce a product reformate of increased aromatics content. The naphtha fraction is typically a full boiling range fraction having an initial boiling point of from 10° to 70° C. and an end boiling point of from about 163° to about 218° C. Such a full boiling range naphtha contains significant amounts of $C_6$-plus naphthenic hydrocarbons. As is well known, these paraffinic and naphthenic hydrocarbons are converted to aromatics by means of multifarious reaction mechanisms. These mechanisms include dehydrogenation, dehydrocyclization, isomerization followed by dehydrogenation. Naphthenic hydrocarbons are converted to aromatics by dehydrogenation. Paraffinic hydrocarbons may be converted to the desired aromatics by dehydrocyclization and may also undergo isomerization. Accordingly then, it is apparent that the number of reactions taking place in a catalytic reforming zone are numerous and, therefore, the typical reforming catalyst must be capable of effecting numerous reactions to be considered usable in a commercially feasible reaction system.

Because of the complexity and number of reaction mechanisms ongoing in catalytic reforming, it has become a recent practice to attempt to develop highly specific catalysts tailored to convert only specific reaction species to aromatics. A disadvantage in processing $C_6$–$C_8$ paraffins is that elevated temperatures are required for the reaction to proceed and the selectivity is directed toward undesired reactions such as hydrocracking. Until recently, traditional reforming catalyst compositions were not satisfactory for the conversion of light paraffinic hydrocarbons to aromatics. Today, catalyst compositions containing L-zeolite have been successfully used to selectively dehydrocyclize $C_6$–$C_8$ paraffins to aromatics. As can be appreciated by those of ordinary skill in the art, increased production of aromatics is desirable. The increased aromatic content of gasolines, a result of lead phase-down, as well as demands in the petrochemical industry, makes $C_6$–$C_8$ aromatics highly desirable products. However, the activity and activity-stability of these catalysts is well below what is needed for commercial processing of these light paraffinic hydrocarbons. It is, therefore, very advantageous to have a process for reforming light paraffins which exhibits high activity while producing a high yield of aromatics.

OBJECTS AND EMBODIMENTS

A principal object of the present invention is to provide an improved dehydrocyclization process for conversion of light hydrocarbons to aromatics which is characterized by a surprising and unexpected means to increase the activity of a nonacidic L-zeolite containing catalyst.

Accordingly, a broad embodiment of the invention is directed toward an improved process for the dehydrocyclization of aliphatic hydrocarbons which comprises contacting a $C_6$–$C_{10}$ hydrogen feedstock in a reaction zone at dehydrocyclization conditions with a catalyst comprising nonacidic L-zeolite, a Group VIII metal component, and an inorganic oxide support matrix, and removing aromatic products from the reaction zone, wherein the improvement comprises adding water, water precursors, or mixtures thereof to the reaction zone.

A further embodiment of the present invention relates to an improved process for reforming light paraffins which comprises contacting a hydrocarbon feedstock of $C_6$–$C_8$ paraffins in the presence of hydrogen in a reaction zone at a pressure from about 172 to about 1379 kPa (ga), a temperature from about 350° to 650° C., and a liquid hourly space velocity of from about 0.1 to about 10 $hr^{-1}$, with a catalyst comprising 25 to 95 wt.% nonacidic L-zeolite, a platinum component, and an inorganic oxide support wherein the improvement comprises adding to the reaction zone 10 to 100 ppm calculated as $H_2O$ and based on the weight of the hydrocarbon feedstock.

INFORMATION DISCLOSURE

The art recognizes that aliphatic hydrocarbons can be effectively converted to aromatics by utilizing catalysts containing L-zeolite and a Group VIII metal. Further, many references teach a variety of processes for producing aromatics from $C_6$–$C_{10}$ paraffinic hydrocarbons. However, to our knowledge, no reference has disclosed the surprising and unexpected means of the present invention which provides an improved dehydrocyclization process.

In U.S. Pat. No. 4,104,320, a process for dehydrocyclizing aliphatic hydrocarbons is disclosed which utilizes a type L-zeolite having exchangeable cations of which at least 90% are alkali metal ions and containing at least one metal selected from the group which consists of Group VIII, tin, and germanium. This reference fails to disclose the addition of water, water precursors, or mixtures thereof into the dehydrocyclization reaction zone.

U.S. Pat. No. 4,456,527 provides a means for improving the stability of a dehydrocyclization process employing an L-zeolite based catalyst. This reference teaches that catalyst run life can be greatly improved by maintaining the sulfur concentration in the feed to less than 100 ppb. U.S. Pat. No. 4,627,912 discloses a catalytic reforming process which utilizes L-zeolite and the addition of a halogen to control the degree of isomerization and dehydroisomerization. This reference does disclose that water can be added to the process to reduce the halogen content of the catalyst. However, it does not teach the constant addition of water, water precursors, or mixtures thereof at the concentrations as found in the present invention.

In U.S. Pat. No. 4,652,689, a dehydrocyclization process is taught for converting $C_6$-plus paraffinic hydrocarbons to their corresponding aromatics by contacting the hydrocarbons with an L-zeolite based catalyst. This reference, however, also teaches that the charge stock used in the process must be pretreated to remove substantially all water-yielding contaminants. Thus, the reference in effect teaches away from the improved dehydrocyclization process of the present invention.

DETAILED DESCRIPTION OF THE INVENTION

To reiterate briefly, the present invention is directed to an improved process for the dehydrocyclization of $C_6$–$C_{10}$ hydrocarbons. Surprisingly, and unexpectedly, it has been found that the inclusion of water, water precursors, or mixtures thereof into the dehydrocyclization reaction zone increases the effective catalyst activity. The catalyst of the invention comprises a nonacidic L-zeolite, a Group VIII metal component, and an inorganic oxide support matrix.

A wide rage of hydrocarbon charge stocks may be employed in the process of the present invention. The exact charge stock utilized will, of course, depend on the precise use of the catalyst. Typically, hydrocarbon charge stocks which may be used in the present invention will contain naphthenes and paraffins although, in some cases, aromatics and olefins may be present. Accordingly, the class of charge stocks which may be utilized includes straight-run naphthas, natural naphthas, synthetic naphthas, and the like. Alternatively, straight-run and cracked naphthas may also be used to advantage. The naphtha charge stock may be a full boiling range naphtha having an initial boiling point of from about 10°–70° C. and an end boiling point within the range of from about 163°–218° C., or may be a selected fraction thereof. Generally, any feed rich in paraffinic hydrocarbons will be applicable, preferably those with a low percentage of branched paraffins, such as, raffinates from aromatic extraction processes or extracts from molecular sieve separation processes. These highly paraffinic feeds have an end boiling point within the range of from about 95°–115° C. It is preferred that the charge stocks employed in the present invention be treated by conventional catalytic pretreatment methods such as hydrorefining, hydrotreating, hydrodesulfurization, etc. to remove substantially all sulfurous and nitrogenous contaminants therefrom.

It is preferred that the charge stock of the instant invention substantially comprise paraffins. This, of course, is a result of the fact that the purpose of a dehydrocyclization process is to convert paraffins to aromatics. Because of the value of $C_6$–$C_8$ aromatics, it is additionally preferred that the hydrocarbon charge stock comprise $C_6$–$C_8$ paraffins. However, notwithstanding this preference, the hydrocarbon charge stock may comprise naphthenes, aromatics, and olefins in addition to $C_6$–$C_8$ paraffins.

In addition to the hydrocarbons, the present invention requires that water, water precursors, or mixtures thereof also be present in the dehydrocyclization reaction zone. The surprising and unexpected advantage that results from the presence of water in the reaction zone is not fully understood and is contrary to prior art teachings that water has a deleterious effect on reforming processes utilizing traditional non-zeolitic based catalysts. These catalysts typically comprise highly dispersed platinum supported on a gamma-alumina. Exposing these traditional reforming catalysts to a water environment causes the highly dispersed platinum to agglomerate which greatly reduces the number of active sites available for the reforming reactions. Reduction in the reaction sites results in lower feedstock conversion when the temperature is held which in turn yields a liquid product with lower octane value. The reforming process of the instant invention does not respond in the same manner to water as the processes of the prior art. Without wishing to be bound by a particular theory, it is believed that the water in combination with the nonacidic L-zeolite prevents the deleterious agglomeration of the Group VIII metal component by maintaining the metal highly dispersed within the zeolite structure. The result is an increase in catalytically active sites, higher conversion of desired products, and a liquid product with increased octane value.

Any suitable means known to the art may be used to introduce the water into the reaction zone. For example, water and/or water precursors may be added directly to the hydrocarbons or added directly into a recycle gas stream that supply molecular hydrogen to the reaction zone. Alternatively, the water and/or precursors may be added via a separate independent stream into the reaction zone. Any compound that readily decomposes to yield water can be employed as a water precursor. Examples of suitable water precursors include alcohols and ethers, with the most preferred being tert-butyl alcohol. It is preferred that the quantity of water or its equivalent weight present in the dehydrocyclization reaction zone range from 1 to 500 wt. ppm based on the weight of hydrocarbon feedstock, with a most preferred water level of 10 to 100 wt. ppm.

According to the present invention, the hydrocarbon feedstock is contacted in the presence of water, water precursors, or mixtures thereof with a catalyst in a reaction zone maintained at dehydrocyclization reaction conditions. Dehydrocyclization conditions include a pressure of from about 101 kPa (abs) to about 4137 kPa (ga), with the preferred pressure being from about 172 to about 1379 kPa (ga), a temperature of from about 350° to 650° C., and a liquid hourly space velocity of from about 0.1 to about 10 $hr^{-1}$.

Preferably, hydrogen may be employed as diluent in the reaction zone. Although hydrogen is the preferred diluent for use in the subject dehydrocyclization method, in some cases, other art-recognized diluents may be advantageously utilized, either individually or in admixture with hydrogen, such as $C_1$–$C_3$ paraffins such as methane, ethane, propane, and butane; the like diluents, and mixtures thereof. Hydrogen is preferred because it serves the dual function of not only lowering the partial pressure of the acyclic hydrocarbon, but also of suppressing the formation of hydrogen-deficient, carbonaceous deposits (commonly called coke) on the catalytic composite. Ordinarily, hydrogen is utilized in amounts sufficient to ensure a hydrogen to hydrocarbon mole ratio of about 0 to about 20:1, with best results obtained in the range of about 0.2:1 to about 10:1. The hydrogen charged to the dehydrocyclization zone will typically be contained in a hydrogen-rich gas stream recycled from the effluent stream from this zone after a suitable gas/liquid separation step.

In accordance with the present invention, a hydrocarbon charge stock is contacted with the catalyst in a hydrocarbon conversion zone. This contacting may be accomplished by using the catalyst in a fixed-bed system, a moving-bed system, a fluidized-bed system, or in a batch-type operation. The hydrocarbon charge stock and, if desired, a hydrogen-rich gas as diluent are typically preheated by any suitable heating means to the desired reaction temperature and then are passed into a conversion zone containing the catalyst of the invention. It is, of course, understood that the conversion zone may be one or more separate reactors within suitable means therebetween to ensure that the desired conversion temperature is maintained at the entrance to each reactor. It is also important to know that the reactants may be contacted with the catalyst bed in either upward, downward, or radial-flow fashion. When the final shape of the catalyst is spherical, the latter method is preferred. In addition, the reactants may be in the liquid phase, a mixed liquid-vapor phase, or a vapor phase when they contact the catalyst. Best results are obtained when the reactants are in the vapor phase.

After contact with the catalyst, the hydrocarbon stock having undergone dehydrocyclization is withdrawn as an effluent stream from the reaction zone and passed through a cooling means to a separation zone. In the separation zone, the effluent may be separated into various constituents depending upon the desired products. When hydrogen is utilized as a diluent in the reaction zone, the separation zone will typically comprise a vapor-liquid equilibrium separation zone and a fractionation zone. A hydrogen-rich gas is separated from a high octane liquid product containing aromatics generated within the dehydrocyclization zone. After separation, at least a portion of the hydrogen-rich gas may be recycled back to the reaction zone as diluent. The balance of the hydrogen-rich gas may be recovered for use elsewhere. The high octane liquid product comprising aromatics may then be passed to a fractionation zone to separate aromatics from the unconverted constituents of the charge stock. Alternatively, the liquid product may be passed to either a solvent extraction process or molecular sieve separation process to accomplish the separation of aromatics from unconverted materials. These unconverted constituents may then be passed back to the reaction zone for processing or other processes for utilization elsewhere.

The dehydrocyclization catalyst according to the invention comprises a nonacidic L-zeolite, a Group VIII metal component, and an inorganic oxide support matrix. By "nonacidic zeolite", it is to be understood that it is meant that the zeolite has substantially all of its cationic sites of exchange occupied by nonhydrogen cationic species. Preferably, such cationic species will comprise the alkali metal cations although other cationic species may be present. Irrespective of the actual type of cationic species present in the sites of exchange, the nonacidic zeolite in the present invention has substantially all of the cationic sites occupied by nonhydrogen cations, thereby rendering the zeolite substantially fully cationic exchanged. Many means are well known in the art for arriving at a substantially fully cationic exchanged zeolite and thus they need not be elaborated herein.

The especially preferred type of nonacidic zeolite of the present invention is L-zeolite. Type L-zeolites are synthetic zeolites. A theoretical formula is:

$$M_{9/n}[(AlO_2)_9(SiO_2)_{27}]$$

in which M is a cation having the valency n. The actual formula may vary without changing the crystalline structure. For example, the mole ratio of silicon to aluminum (Si/Al) may vary from 1.0 to 3.5.

Another essential feature of the catalyst is the support matrix in which the nonacidic zeolite is bound. As is well known in the art, use of a support matrix enhances the physical strength of the catalyst. Additionally, use of a support matrix allows formation of shapes suitable for use in catalytic conversion processes. For example, the nonacidic zeolite of the present invention may be bound in the support matrix such that the final shape of the catalytic composite is a sphere. The use of spherical shaped catalyst is, of course, well known to be advantageous in various applications. In particular, when the catalyst of the instant invention is employed within a continuously moving bed hydrocarbon conversion process, a spherical shape enhances the ability of the catalyst to move easily through the reaction and regeneration zones. Of course, other shapes may be employed where advantageous. Accordingly, the catalytic composite may be formed into extrudates, saddles, etc.

The support matrix of the present invention may comprise any support matrix typically utilized to bind zeolite-containing catalytic composites. Such support matrices are well known in the art and include clays, bauxite, refractory inorganic oxides such as alumina, zirconium dioxide, hafnium oxide, beryllium oxide, vanadium oxide, cesium oxide, chromium oxide, zinc oxide, magnesia, thoria, boria, silica-magnesia, chromia-alumina, alumina-boria, etc. A preferred support matrix comprises either silica or alumina. It is further preferred that the support matrix be substantially inert to the reactants to be converted by the composite as well as the other constituents of the composite. To this end, it is preferred that the support matrix be nonacidic to avoid promotion of undesirable side reactions. Such nonacidity may be induced by the presence of alkali metals such as those comprising the surface-deposited alkali metal.

The nonacidic zeolite may be bound within the support matrix by any method known in the art. Such methods include pilling, extruding, granulating, marumarizing, etc. One preferred method is the so-called oil drop method.

Typically, in binding a zeolite in a support matrix by means of the oil drop method, powdered zeolite is admixed with a sol comprising the desired support matrix or precursors thereof, and a gelling agent. Droplets of the resulting admixture are dispersed as spherical droplets in a suspending medium, typically oil. The gelling agent thereafter begins to cause gelation of the sol as a result of the change on the sol pH. The resulting gelled support matrix has bound therein the zeolite. The suspending medium helps maintain the spherical shape of the droplets. Usable suspending mediums include Nujol, kerosene, selected fractions of gas oil, etc. Many gelling agents are known in the art and include both acids and bases. Hexamethylenetetramine is only one such known gelling agent. The hexamethylenetetramine slowly decomposes to ammonia upon heating. This results in a gradual pH change and as a result, a gradual gelation.

Regardless of the exact method of binding the nonacidic zeolite in the support matrix, sufficient nonacidic zeolite may be used to result in a catalytic composite comprising from about 25 to about 95 wt.% nonacidic zeolite based on the weight of the zeolite and support matrix. The exact amount of nonacidic zeolite, advantageously included in the catalytic composite of the invention, will be a function of the specific nonacidic zeolite, the support matrix and the specific application of the catalytic composite. A catalytic composite comprising about 50 to 85 wt.% potassium form of L-zeolite bound in a support matrix is advantageously used in the dehydrocyclization of $C_6$–$C_8$ hydrocarbons.

A further essential feature of the catalyst of the present invention is the presence of catalytically effective amounts of a Group VIII metal component, including catalytically effective amounts of nickel component, rhodium component, palladium component, iridium component, platinum component, or mixtures thereof. Especially preferred among the Group VIII metal components is a platinum component. The Group VIII metal component may be composited with the other constituents of the catalytic composite by any suitable means known in the art. For example, a platinum component may be impregnated by means of an appropriate solution such as a dilute chloroplatinic acid solution. Alternatively, the Group VIII metal component may be composited by means of ion exchange in which case, some of the cationic exchange sites of the nonacidic zeolite may contain Group VIII metal cations. After ion exchange, the Group VIII metal may be subject to a low temperature oxidation prior to any reduction step. The Group VIII metal component may be composited with the other constituents either prior or subsequent to the deposition of the hereinafter described surface-deposited alkali metal. Additionally, the Group VIII metal may be composited with the nonacidic zeolite and thereafter, the nonacidic zeolite containing Group VIII metal may be bound with the support matrix.

Irrespective of the exact method of compositing the Group VIII metal component into the catalytic composite, any catalytically effective amount of Group VIII metal component may be employed. The optimum Group VIII metal component content will depend generally on which Group VIII metal component is utilized in the catalyst of the invention. However, generally from about 0.01 to about 5.0 wt.% of the Group VIII metal component based on the weight of the support matrix zeolite and Group VIII metal component.

It is believed that best results are achieved when the Group VIII metal is substantially all deposited on the nonacidic zeolite as opposed to the support matrix. It is also advantageous to have the Group VIII metal component highly dispersed. The Group VIII metal component is most effective in a reduced state. Any suitable means may be employed for reducing the Group VIII metal component and many are well known in the art. For example, after compositing, the Group VIII metal component may be subjected to contact with a suitable reducing agent, such as hydrogen, at an elevated temperature for a period of time.

In addition to comprising a Group VIII metal component, it is contemplated in the present invention that the catalyst thereof may contain other metal components well known to have catalyst-modifying properties. Such metal components include components of rhenium, tin, cobalt, indium, gallium, lead, zinc, uranium, thallium, dysprosium, germanium, etc. Incorporation of such metal components have proven beneficial in catalytic reforming as promoters and/or extenders. Accordingly, it is within the scope of the present invention that catalytically effective amounts of such modifiers may be beneficially incorporated into the catalyst of the present invention improving its performance.

In order to more fully demonstrate the attendant advantages arising from the present invention, the following example is set forth. It is to be understood that the following is by way of example only and is not intended as an undue limitation on the otherwise broad scope of the present invention.

EXAMPLE

To fully demonstrate the improved dehydrocyclization process of the instant invention, a comparison was made against a prior art process. The comparison was made in a single run of a pilot plant testing apparatus. The pilot plant test run was conducted in two parts, the first part as a prior art process and the second part as the process of the instant invention. The hydrocarbon feedstock used in the run had the following analysis:

$C_3/C_4/C_5$: 0.4 wt.%
$C_6$ paraffins: 44.3 wt.%
$C_6$ naphthenes: 3.1 wt.%
$C_7$ paraffins: 44.4 wt.%
$C_7$ naphthenes: 1.9 wt.%
$C_8$ paraffins: 1.6 wt.%
$A_6$: 0.3 wt.%
$A_7$: 1.1 wt.%
olefins: 2.9 wt.%
sulfur: <50 wt.ppb The catalyst used in the test comprised about 85 wt.% potassium form L-zeolite, about 0.6 wt.% platinum, and the balance, silica support matrix. The dehydrocyclization conditions included a reaction zone pressure of 414 kPa (ga), a recycle hydrogen to feed molar ratio of 2:1, and a 1.0 $hr^{-1}$ liquid hourly space velocity. Reaction temperature during the first part of the test was periodically adjusted to maintain a research octane of the product of 90 RONC.

In the first part of the test run, the water level in the feedstock fed to the reaction zone was controlled to less than 1.0 wt. ppm, based on the weight of the hydrocarbon feedstock, by passing the feedstock through a high surface area sodium drier. For the second part of the test run, the feedstock drier was removed and 135 wt. ppm of tert-butyl alcohol was added to the feedstock. This quantity of water precursor, when decomposed in the reaction zone, is equivalent to 40 wt. ppm $H_2O$. Except for the addition of water to the reaction zone, the process variables in the second part of the test were identical to those in the first part.

The improved performance resulting from the addition of water is shown in the following table:

| | Part I | Part II |
|---|---|---|
| Wt. ppm Water Added to Reaction Zone | <1.0 | 40 |
| Product Octane, RONC | 90 | 92 |
| Total Aromatic Yield, wt. % | 47.4 | 48.8 |
| Hydrogen Yield, SCFB | 1825 | 1950 |

What is claimed is:

1. An improved process for the dehydrocyclization of aliphatic hydrocarbons which comprises contacting a $C_6$–$C_{10}$ hydrocarbon feedstock in a reaction zone at dehydrocyclization conditions with a catalyst comprising nonacidic L-zeolite, a Group VIII metal component, and an inorganic oxide support matrix, and removing aromatic products from the reaction zone, wherein the improvement comprises adding water, water precursors, or mixtures thereof to the reaction zone.

2. The process of claim 1 further characterized in that the quantity of water, water precursors, or mixtures thereof entering the reaction zone is in the range of 10 to 100 ppm calculated as $H_2O$ and based on the weight of hydrocarbon feedstock.

3. The process of claim 1 further characterized in that the dehydrocyclization conditions comprise a pressure of from about 101 kPa (abs) to about 4137 kPa (ga), a temperature of from about 350° to 650° C., a liquid hourly space velocity of from about 0.1 to about 10 $hr.^{-1}$, and a molar ratio of hydrogen to hydrocarbon feedstock of about 0.1 to about 10.

4. The process of claim 1 further characterized in that the catalyst comprises from about 25 to 95 wt.% non-acidic L-zeolite based on the weight of zeolite and support matrix.

5. The process of claim 1 further characterized in that the Group VIII metal component comprises a platinum component.

6. The process of claim 1 further characterized in that the inorganic oxide support matrix comprises alumina.

7. The process of claim 1 further characterized in that the inorganic oxide support matrix comprises silica.

8. An improved process for reforming light paraffins which comprises contacting a hydrocarbon feedstock of $C_6$–$C_8$ paraffins in the presence of hydrogen in a reaction zone at a pressure from about 172 to about 1379 kPa (ga), a temperature from about 350° to 650° C., and a liquid hourly space velocity of from about 0.1 to about 10 $hr^{-1}$, with a catalyst comprising 25 to 95 wt.% non-acidic L-zeolite, a platinum component, and an inorganic oxide support wherein the improvement comprises adding to the reaction zone 10 to 100 ppm calculated as $H_2O$ and based on the weight of the hydrocarbon feedstock.

* * * * *